United States Patent [19]

Arrington et al.

[11] Patent Number: 5,009,714

[45] Date of Patent: Apr. 23, 1991

[54] PROCESS FOR REMOVING COPPER AND COPPER OXIDE DEPOSITS FROM SURFACES

[75] Inventors: Stephen T. Arrington; Gary W. Bradley, both of Duncan, Okla.

[73] Assignee: Halliburton Company, Duncan, Okla.

[21] Appl. No.: 398,687

[22] Filed: Aug. 25, 1989

[51] Int. Cl.[5] ..... C03C 23/00

[52] U.S. Cl. ..... 134/2; 134/26; 134/36; 134/42

[58] Field of Search ..... 134/2, 3, 22, 16, 28, 134/34, 35, 36, 41, 42, 26

[56] References Cited

U.S. PATENT DOCUMENTS

| | | | |
|---|---|---|---|
| 3,072,502 | 1/1963 | Alfano | 134/3 |
| 3,248,269 | 4/1966 | Bell | 134/2 |
| 3,438,811 | 4/1969 | Harriman et al. | 134/2 |
| 4,443,268 | 4/1984 | Cook | 134/2 |
| 4,586,961 | 5/1986 | Bradley et al. | 134/2 |
| 4,666,528 | 5/1987 | Arrington et al. | 134/2 |

*Primary Examiner*—Curtis R. Davis

*Attorney, Agent, or Firm*—Robert A. Kent

[57] ABSTRACT

A process for removing elemental copper and copper oxide deposits from a metal surface without first removing iron containing deposits therefrom. The process comprises the step of contacting the surface with an aqueous cleaning solution comprising gaseous oxygen present in an amount sufficient to oxidize at least a substantial portion of the elemental copper deposits present on the surface to copper oxide deposits and sufficient amounts of ammonia and an inorganic ammonium salt to dissolve at least a substantial portion of the copper oxide deposits present on the surface.

18 Claims, No Drawings

PROCESS FOR REMOVING COPPER AND COPPER OXIDE DEPOSITS FROM SURFACES

BACKGROUND OF THE INVENTION

1. Field of the Invention

This invention relates to methods and compositions for cleaning metal surfaces, and more particularly, to methods and compositions for removing elemental copper and copper oxide deposits from metal surfaces.

2. Description of the Prior Art

The operation of process equipment such as steam boilers, heat exchangers, feed water heaters and other equipment through which water is circulated is often hindered by the formation of water insoluble deposits on the interior metal surfaces thereof. Such deposits often contain various forms of iron such as iron salts and iron oxides, e.g., magnetite and hematite, as well as copper in the form of elemental copper and copper oxides. The presence of water insoluble deposits on the interior metal surfaces of process equipment can decrease the capacity of flow passages, interfere with proper heat transfer and lead to leaks and ruptures which necessitate undesirable down time and maintenance costs.

In order to prevent the above problems from occurring, a variety of methods and solvents have been developed for removing water insoluble deposits from the interior metal surfaces of equipment. The type of method and solvent employed depends primarily on the nature of the deposits involved. Typical solvents include acids such as hydrochloric acid and nitric acid, and ammonia or amine salts of organic chelating acids such as citric acid and ethylenediaminetetraacetic acid (EDTA). Many methods and solvents are designed for the removal of both iron and copper containing deposits. For example, in U.S. Pat. No. 3,248,269 to Bell, a two step process for removing both copper and iron deposits from metal surfaces is disclosed. First, the surfaces are contacted with a neutral ammonium citrate solution to dissolve iron oxides. During the course of this reaction, ammonia and/or ammonium hydroxide is produced in situ which raises the pH of the solution. The ammoniacal solution together with iron and/or iron salts, e.g., ferrous citrate, formed in the first step then dissolve copper oxides.

Unfortunately, the number of methods and solvents available for dissolving only elemental copper and copper oxides from metal surfaces is limited. Methods and solvents such as the method and solvent described above designed for dissolving both iron and copper deposits typically do not effectively remove copper deposits by themselves, i.e., such methods and solvents only effectively remove copper deposits after they have been used to dissolve iron deposits. When iron deposits are not involved, copper deposits are most commonly removed by ammoniacal solvents containing oxidizing agents. The oxidizing agents oxidize elemental copper to copper oxide while ammonia or ammoniacal compounds dissolve copper oxide. Conventional oxidizing agents employed in these solvents include sodium bromate [$NaBrO_3$] and ammonium persulfate [$(NH_4)_2S_2O_8$]. Sodium bromate is the most widely used.

While ammoniacal solvents employing sodium bromate or ammonium persulfate as an oxidizing agent effectively remove elemental copper and copper oxide deposits in the absence of iron, they are very hazardous to use and difficult to dispose of. Sodium bromate decomposes upon contact with acid yielding bromine, a poisonous gas. Inasmuch as copper removal processes are often performed in conjunction with acid cleaning, the potential for bromine generation commonly exists. Both sodium bromate and ammonium persulfate are strong oxidizing agents. As a result, the potential for fires and explosions when handling these oxidizing agents is high. If solutions of sodium bromate and/or ammonium persulfate impregnate combustible material such as wood, paper or clothing and are allowed to dry, impact or friction can cause the material to ignite.

In order to dispose of solvents containing sodium bromate and/or ammonium persulfate, the sodium bromate and/or ammonium persulfate must be neutralized or reacted with a reducing agent. This results in further personnel hazards, extra storage and mixing requirements and additional expense.

By the present invention, a process for safely removing elemental copper and copper oxide deposits from metal surfaces without first removing iron containing deposits therefrom is provided.

SUMMARY OF THE INVENTION

The present invention provides a process for removing elemental copper and copper oxide deposits from a metal surface without first removing iron containing deposits therefrom. The process comprises the steps of: (1) contacting the surface with an aqueous cleaning solution comprising gaseous oxygen present in an amount sufficient to oxidize at least a substantial portion of the elemental copper deposits present on the surface to copper oxide deposits and sufficient amounts of ammonia and an inorganic ammonium salt to dissolve at least a substantial portion of the copper oxide deposits present on the surface; and (2) removing the aqueous cleaning solution from the surface.

The cleaning solution employed in the inventive process effectively dissolves elemental copper and copper oxide deposits even though it does not contain substantial amounts of uncomplexed and complexed iron. Unlike other solvents designed for removing elemental copper and copper oxide deposits from metal surfaces without first removing iron deposits therefrom, the cleaning solution employed in the inventive process is not dangerous to use and is easy to dispose of. Gaseous oxygen does not react with other chemicals to yield poisonous gasses and is not flammable. Solvents containing gaseous oxygen do not require neutralization of the oxidants before they can be discarded.

It is, therefore, a principal object of the present invention to provide an improved process for removing elemental copper and copper oxide deposits from a metal surface without first removing iron containing deposits therefrom.

Numerous other objects, features and advantages of the present invention will be readily apparent to those skilled in the art upon a reading of the following disclosure including the examples provided therewith.

DESCRIPTION OF THE PREFERRED EMBODIMENTS

In accordance with the present invention, a process for removing elemental copper and copper oxide deposits from a metal surface without first removing iron containing deposits therefrom is provided. The phrase "without first removing iron containing deposits therefrom" is included in the definition of the inventive process only to distinguish the process from two step processes for removing both iron and copper deposits such as the process described in U.S. Pat. No. 3,248,269 to Bell. Unlike processes such as the process described in U.S. Pat. No. 3,248,268 to Bell in which copper deposits are removed with an ammoniacal solution and oxidizing agent together with iron and/or iron salts dissolved by the solution in an iron removal step, the process of the present invention removes elemental copper and copper oxide deposits with an ammoniacal solution and oxidizing agent by themselves.

The process of the present invention comprises the steps of: (1) contacting the surfaces with an aqueous cleaning solution comprising gaseous oxygen present in an amount sufficient to oxidize at least a substantial portion of the elemental copper deposits present on the surface to copper oxide deposits and sufficient amounts of ammonia and an inorganic ammonium salt to dissolve at least a substantial portion of the copper oxide deposits present on the surface; and (2) removing the aqueous cleaning solution from the surface.

The gaseous oxygen oxidizing agent can be added to the aqueous cleaning solution by a variety of techniques. It can be added to the solution before the surface is contacted therewith, while the surface is contacted therewith or both. It can be injected into the solution by bubbling or sparging techniques, forced into the solution by placing the solution in a closed pressurized oxygen atmosphere or both. The particular technique or combination of techniques employed depends primarily on the nature and density of the deposits and the type of equipment being cleaned.

Preferably the ammonia and inorganic ammonium salt are combined with water to form the aqueous cleaning solution and the gaseous oxygen is injected into the solution while the surface is contacted therewith. The gaseous oxygen can be injected into the solution either continuously or intermittently. Preferably, the gaseous oxygen is continuously injected into the aqueous cleaning solution while the surface is contacted therewith at a rate sufficient to oxidize all of the elemental copper deposits present on the surface to copper oxide deposits. The rate of injection is preferably in the range of from about 1 scfm per 10,000 gal. to about 200 scfm per 10,000 gal., more preferably in the range of from about 10 scfm per 10,000 gal. to about 50 scfm per 10,000 gal. In many applications, a sufficient amount of gaseous oxygen can be imparted to the solution by injecting the oxygen into the solution continuously for awhile and then intermittently as the process is carried out.

The rate of copper dissolution achieved by the process of the present invention is increased by contacting the surface with the aqueous cleaning solution under a closed oxygen atmosphere at a superatmospheric pressure. Preferably, the surface is contacted with the aqueous cleaning solution under an oxygen atmosphere at from atmospheric pressure to a pressure in the range of from about 100–150 psig at the highest point in the vessel being treated. As shown in Table VI of Example IV below, the rate of copper dissolution increases with increasing oxygen pressures up to about 75–100 psig. It is to be understood that oxygen pressures higher than about 100–150 psig can be utilized in the performance of the method of the present invention.

Most preferably, the gaseous oxygen is continuously injected into the aqueous cleaning solution as the surface is contacted therewith under an oxygen atmosphere. In most applications, the surface being cleaned can be contacted with the aqueous cleaning solution under an oxygen atmosphere at a superatmospheric pressure by sealing the surface (e.g., closing off the flow passages) and injecting gaseous oxygen into the solution until a sufficient amount of oxygen is released into the vapor spaces around the solution to build up the desired pressure. The desired pressure can be maintained by continuous oxygen injection while bleeding off oxygen at the required rate.

The primary function of the gaseous oxygen is to oxidize elemental copper deposited on the metal surface to copper oxide allowing the copper to be dissolved by the ammonia and inorganic ammonium salts. Additionally, the oxidizing agent oxidizes the dissolved copper ions to form the stable cupric form and to maintain the exposed ferrous surfaces in a passive state to prevent the formation of undersirable iron oxides.

In order for the aqueous cleaning solution of the present invention to effectively dissolve copper oxides from the metal surface, it is important for the solution to contain both ammonia and an inorganic ammonium salt. The ammonia and inorganic ammonium salt function to dissolve copper oxides from the metal surface by forming complex copper coordination compounds wherein the ammonium salt furnishes an enriched concentration of ionized ammonia.

The ammonia employed in the aqueous cleaning solution can be employed in any form. Preferably, the desired amount of ammonia is imparted to the solution by admixing an appropriate amount of an aqueous ammonia solution ($NH_4OH$) consisting of, for example, 30% by weight ammonia, therewith. The ammonia can also be added to the aqueous cleaning solution by injecting anhydrous ammonia.

The inorganic ammonium salt employed in the aqueous cleaning solution is preferably selected from the group consisting of ammonium bicarbonate ($NH_4HCO_3$), ammonium nitrate ($NH_4NO_3$), ammonium sulfate ($(NH_4)_2SO_4$), ammonium carbonate and ammonium phosphate. Most preferably, the inorganic ammonium salt employed in the aqueous cleaning solution is ammonium bicarbonate or ammonium carbonate. If desired, the inorganic ammonium salt can comprise a mixture of two or more inorganic ammonium salts.

Like the amount of gaseous oxygen, the amounts of ammonia and inorganic ammonium salt employed in the aqueous cleaning solution depend primarily on the nature and density of the deposits and the type of equipment being cleaned. If the equipment being cleaned will only hold a small volume of the solution and the flow passages of the equipment are heavily scaled, the ammonia, inorganic ammonium salt and gaseous oxygen should all be present in the solution in high concentrations. Preferably, sufficient amounts of the ammonia and inorganic ammonium salt are employed to dissolve all of the copper oxide deposits present on the surface. For most steam boilers, heat exchangers and similar equipment, the aqueous cleaning solution will generally comprise in the range of from about 0.04% to about 10% by weight ammonia and in the range of from about 0.01% to about 4% by weight of the inorganic ammonium salt. In most applications, a solution comprising in the range of from about 0.4% to about 4% by weight ammonia and in the range of from about 0.1% to about 2% by weight of the inorganic ammonium salt will rapidly dissolve all of the copper oxide deposits on the metal surface.

The aqueous cleaning solution can be admixed in any manner. Preferably, the aqueous cleaning solution is admixed by dissolving the ammonium salt in water followed by the addition of the ammonia.

Although the type of water employed in the aqueous cleaning solution is not critical to the practice of the invention, it is desirable in some applications to use potable water or water which has a low dissolved mineral salt content.

The rate of copper and copper oxide dissolution increases with increasing temperatures within a certain range. Temperatures above the boiling point of the aqueous cleaning solution can be employed by carrying out the process under a superatmospheric pressure. Preferably, the aqueous solution is maintained at a temperature of at least about 100° F., more preferably at a temperature in the range of from about 125° F. to about 250° F., while the surface is contacted therewith. Most preferably, the aqueous cleaning solution is maintained at a average temperature of at least about 150° F. while the surface is contacted therewith. Preferably, the temperature of the aqueous cleaning solution is adjusted to the desired range or value before the surface is contacted therewith and maintained in the desired range or at the desired value while the process is carried out, i.e., until the copper and copper oxide deposits have been dissolved.

The pH of the aqueous cleaning solution is preferably at least about 8, more preferably in the range of from about 9 to about 11. Most preferably, the pH of the aqueous cleaning solution is about 10. As used herein and in the appended claims, the term pH refers to pH measured at ambient temperature. The pH of the aqueous cleaning solution can be maintained in the desired range or at the desired value while the surface is contacted therewith by adding more ammonia or ammonium salt to the solution.

In carrying out the process of the present invention, the required amounts of the ammonia and inorganic ammonium salt are preferably first admixed with water to form the aqueous cleaning solution as described above. If desired, gaseous oxygen can be admixed into the solution at this time. Next, the surface being cleaned is contacted with the aqueous cleaning solution in an amount sufficient and for a period of time sufficient for the solution to dissolve elemental copper and copper oxide deposits therefrom. The solution having the copper and copper oxide deposits dissolved therein is then removed from the surface and discarded.

The metal surface or surfaces of the equipment being cleaned can be contacted with the aqueous cleaning solution by a variety of techniques, e.g., by static or agitated soaking, pouring, spraying or circulating. Normally, the interior metal surfaces of process equipment can be sufficiently cleaned by filling the vessel with the aqueous cleaning solution. Preferably, the aqueous cleaning solution is continuously circulated through the equipment over the surfaces being cleaned.

The amount of the aqueous cleaning solution employed and the period of time for which the solution is allowed to contact the surface being cleaned depend on the nature and density of the deposits and the type of the equipment being cleaned. In cleaning equipment such as heat exchangers and steam boilers, the aqueous cleaning solution is preferably introduced in an amount sufficient to substantially fill the equipment. From time to time, additional amounts of the cleaning solution can be added to the original quantity to prevent the solution from becoming spent before the process is complete. The gaseous oxygen is preferably injected into the solution. The pressure and temperature at which the process is carried out can be monitored and controlled by well known conventional techniques.

Preferably, the concentration of copper in the solution is monitored while the process is carried out. The copper concentration can be monitored by any standard procedure. Assuming the solution does not become prematurely saturated or spent, the process is generally complete once the concentration of copper in the solution becomes stable. In certain equipment, it may be necessary to drain and refill the equipment more than one time before the surfaces are sufficiently cleaned. Generally, the surfaces should be contacted for a period of time of at least about 30 minutes. Once the copper and copper oxide deposits have been removed, a fresh water flush should be carried out in the cleaned equipment to prevent copper ions remaining therein from being replated during subsequent operation of the equipment.

The process of the present invention effectively removes copper and copper oxide deposits from metal surfaces without first removing iron containing deposits therefrom. The aqueous cleaning solution is not harmful to the equipment being cleaned or the personnel carrying out the process. Oxidation of elemental copper to copper oxide using gaseous oxygen minimizes fire and explosion hazards and substantially eliminates the potential for poisonous gas generation. Unlike solutions employing oxidizing agents such as sodium bromate and ammonium persulfate, the aqueous cleaning solution employed in the process of the present invention does not have to be neutralized or reacted with a reducing agent before it is discarded. Thus, the process of the present invention reduces risk to personnel, equipment and the environment while providing effective copper dissolution with minimum equipment and time requirements.

In order to facilitate a clear understanding of the process of the present invention, the following examples are given. Although the examples are presented to illustrate certain specific embodiments of the invention, they are not to be construed so as to be restrictive of the scope and spirit thereof.

EXAMPLE I

Tests were conducted to determine the effectiveness of the process of the present invention in dissolving copper from metal surfaces.

In a first series of tests, test specimens were prepared by plating metallic copper on the interior surface of standard two inch schedule 40 pipe nipples, approximately 6 inches in length. The nipples were then rinsed in deionized water, dried and sealed at one end. Each pipe nipple contained approximately 0.33 to 0.35 grams of copper.

Test cleaning solutions were prepared in accordance with the invention by combining various amounts of aqua ammonia (30% $NH_3$) and ammonium bicarbonate ($NH_4HCO_3$). Each solution was tested by placing approximately 250 milliliters thereof in one of the copper plated pipe nipples and placing the pipe nipple in a thermostated water bath. Gaseous oxygen was continuously injected into the solvent at the desired rate through a sintered glass sparger immersed therein. The rate of flow of the gaseous oxygen into the solvent was monitored and controlled with a rotameter.

Each test was carried out for approximately six hours. The temperature of the solvent in each test was maintained at approximately 150° F. The cleaning solutions were periodically analyzed for dissolved copper content using colorimetric procedures. The results of the first series of tests are shown in Table I below.

TABLE I

| Copper Dissolution | | | | | | | |
|---|---|---|---|---|---|---|---|
| | | | $O_2$ Rate | % Cu In Solution @ | | | |
| Test No. | 30% $NH_3$ (Vol. %) | $NH_4HCO_3$ (Wt. %) | (scfm/ 10,000 Gal.) | 1 Hr. | 2 Hrs. | 4 Hrs. | 6 Hrs. |
| 1 | 1.0 | 0.1 | 20 | 22.2 | 44.4 | 37.0 | 29.6* |
| 2 | 1.0 | 0.1 | 90 | 37.0 | 37.0 | 29.6 | 22.2* |
| 3 | 10 | 0.1 | 20 | 51.8 | 100 | 100 | 100 |
| 4 | 10 | 0.1 | 90 | 100 | 100 | 100 | 100 |
| 5 | 1.0 | 1.0 | 20 | 74.1 | 100 | 100 | 100 |
| 6 | 1.0 | 1.0 | 90 | 100 | 100 | 100 | 100 |
| 7 | 10 | 1.0 | 20 | 44.4 | 100 | 100 | 100 |
| 8 | 10 | 1.0 | 90 | 100 | 100 | 100 | 100 |
| 9 | 6 | 0.6 | 55 | 100 | 100 | 100 | 100 |
| 10 | 6 | 0.6 | 55 | 100 | 100 | 100 | 100 |

*Precipitation of copper oxides was observed.

Although Table I shows that the process of the present invention effectively dissolves copper from metal surfaces, the amount of copper in each test was insufficient to allow for meaningful comparison of the various cleaning solutions. Although effective copper dissolution was achieved in each test, the data indicates that the copper dissolution is somewhat more rapid at higher oxygen injection rates.

Next, in a second series of tests, copper plated pipe nipples and test cleaning solutions were prepared and the copper dissolving abilities of the solvents were determined in accordance with the procedure described above. In this series of tests, however, the rate of flow of gaseous oxygen into the solutions was not varied and the amount of copper available for dissolution by the solution was increased. The rate of flow of gaseous oxygen into the solvents was kept constant at 20 scfm/10,000 gal. The amount of available copper for dissolution by the cleaning solutions was increased by placing two copper coupons, each having a surface area of 4.4 square inches, in each solution. The results of the second series of tests are shown in Table II below.

TABLE II

| Copper Dissolution - Increased Available Copper | | | | | | |
|---|---|---|---|---|---|---|
| | | | wt % Cu Dissolved In Solution @ | | | |
| Test No. | 30% $NH_3$ (Vol. %) | $NH_4HCO_3$ (Wt. %) | 1 Hr. | 2 Hrs. | 4 Hrs. | 6 Hrs. |
| 1 | 10 | 0.1 | 0.11 | 0.19 | 0.16 | 0.16 |
| 2 | 1.0 | 1.0 | 0.12 | 0.20 | 0.26 | 0.26 |
| 3 | 6.0 | 0.6 | 0.06 | 0.20 | 0.40 | 0.40 |
| 4 | 10 | 1.0 | 0.09 | 0.22 | 0.54 | 0.61 |

The results of the second series of tests indicate that copper can be successfully removed by a broad range of constituent compositions.

EXAMPLE II

The abilities of the process of the present invention (inventive process) and a process employing sodium bromate ($NaBrO_3$) as an oxidizing agent (comparative process) to dissolve plated copper from an actual boiler tube section were determined and compared. The boiler tube section tested possessed a deposit density of approximately 80 g/ft.$^2$ with copper comprising 15% of the deposit. Approximately 0.5 grams of copper were deposited on each one inch portion of the section. A separate piece of the boiler tube section was tested for each process.

The cleaning solution employed in the test of the inventive process consisted of 10% by volume of an aqueous solution consisting of 30% by weight ammonia ($NH_3$), and 1% by weight ammonium bicarbonate ($NH_4HCO_3$). Gaseous oxygen was continuously injected into the solution at a rate of 20 scfm/10,000 gal. throughout the test. The cleaning solution employed in the test of the comparative process was designed to remove 0.5% by wt copper. It consisted of 6% by volume of an aqueous solution consisting of 30% by weight ammonia ($NH_3$), and 0.45% by weight ammonium bicarbonate ($NH_4HCO_3$) and 0.45% by weight sodium bromate ($NaBrO_3$).

The tests were conducted by immersing the tube specimens in the prepared solutions for a specified time period. In each test, a solution volume of approximately 100 milliliters was employed and the temperature of the solvent was maintained at approximately 150° F. The results of the tests are shown in Table III below.

TABLE III

| Actual Boiler Tube Section | | | | |
|---|---|---|---|---|
| | wt % Cu In Solution @ | | | |
| Process | 1 Hr. | 2 Hrs. | 4 Hrs. | 6 Hrs. |
| Inventive Process* | 0.10 | 0.15 | 0.16 | 0.18 |
| Comparative Process** | 0.07 | 0.12 | 0.16 | 0.16 |

*The solution consisted of 10% by volume 30% $NH_3$, 1% by weight $NH_4HCO_3$ plus $O_2$ injected at a rate of 20 scfm/10,000 gal.
**The solution consisted of 6% by volume 30% $NH_3$, 0.45% by weight $NH_4HCO_3$ and 0.45% $NaBrO_3$.

The results of the tests show that both the inventive process and the comparative process effectively dissolved copper from the boiler tube section. The amounts of copper dissolved by the processes was somewhat limited due to the inability of the cleaning solutions to contact copper deposits that were shielded by iron oxides.

Next, the boiler tube section pieces tested in the tests described above were exposed to a solvent consisting of approximately 5% by weight hydrochloric acid and 0.25% by weight ammonium bifluoride to effect removal of the iron oxides and then resubjected to the inventive and comparative processes as described above.

The inventive process dissolved all of the remaining copper during the first hour of solvent contact. The comparative process did not dissolve any copper and caused the bare metal to rust. The rusted tube section resulting from the comparative process was then immersed again in the acid solvent, rinsed, dried and subjected to yet another treatment with the comparative process. The results of this third comparative cleaning solution test were successful with all of the remaining copper being removed during the first hour.

Thus, the process of the present invention is just as effective, if not more effective, in dissolving elemental copper and copper oxides from metal surfaces than a process employing sodium bromate as an oxidizing agent.

EXAMPLE III

Tests were carried out to determine the effects of intermittent oxygen injection and cleaning solution temperature on the rate of copper dissolution achieved by the process of the present invention.

Test specimens were prepared by plating metallic copper on the interior surfaces of standard two inch schedule 40 pipe nipples, approximately 6 inches in length. The nipples were then rinsed in deionized water, dried and sealed at one end. The above procedure resulted in each pipe nipple containing approximately 0.33 to 0.35 grams of copper.

Test solutions consisting of 10% by volume of an aqueous solution consisting of 30% by weight ammonia ($NH_3$), and 1% by weight ammonium bicarbonate ($NH_4CO_3$) were prepared in accordance with the present invention. Each solution was tested by placing approximately 250 milliliters thereof in one of the copper plated pipe nipples and placing the pipe nipple in a thermostated water bath. In order to increase the amount of copper available for dissolution, two copper coupons, each having a surface area of 4.4 square inches, were placed in each solvent.

In a first series of tests, the effect of intermittent oxygen injection on the rate of copper dissolution achieved by the process of the present invention was determined. Each test was carried out for approximately 6 hours. Gaseous oxygen was continuously injected into all of the solvents at a rate of approximately 4 cc/min. (equivalent to 20 scfm/10,000 gal.) for the first hour to establish some dissolved oxygen therein. Thereafter, the nature of the oxygen injection was varied with each test. The first solvent was subjected to gaseous oxygen injection at a rate of 4 cc/min. for five minutes each hour. The second solvent was subjected to gaseous oxygen injection at a rate of 4 cc/min. for 10 minutes each hour. The third solvent was subjected to continuous gaseous oxygen injection at a rate of 4 cc/min. throughout the test. Throughout each test, the solvent was periodically analyzed by colorimetric procedures for dissolved copper content. The results of the first series of tests are shown in Table IV below.

In a second series of tests, the effect of solvent temperature on the rate of copper dissolution achieved by the process of the present invention was determined. Each test was carried out for approximately 6 hours. During each test, gaseous oxygen was continuously injected into the solvent at a rate of 4 cc/min. In the first test, the temperature of the solvent was maintained at approximately 72° F. In the second test, the temperature of the solvent was maintained at approximately 100° F. while in the third test, the temperature of the solvent was maintained at 150° F. In each test, samples of the solvent were periodically analyzed by colorimetric procedures for dissolved copper content. The results of the second series of tests are shown in Table V below.

TABLE IV

Copper Dissolution - Effect of Intermittent Oxygen Injection

| Test No. | $O_2$ Injection* | wt % Cu In Solution @ 2 Hrs. | 3 Hrs. | 4 Hrs. | 5 Hrs. | 6 Hrs. |
|---|---|---|---|---|---|---|
| 1 | 5 min./hr. | 0.21 | 0.31 | 0.40 | 0.48 | 0.55 |
| 2 | 10 min./hr. | 0.18 | 0.29 | 0.40 | 0.52 | 0.56 |
| 3 | Continuous** | 0 27 | 0.55 | 0.64 | 0.64 | 0.65 |

*Each solution was continuously injected with gaseous oxygen at a rate of 4 cc/min. (20 scfm/10,000 gal.) for the first hour and thereafter at the same rate for the amount of time specified.

**This solution was continuously injected with gaseous oxygen at a rate of 4 cc/min. (20 scfm/10,000 gal.) for the entire test period.

TABLE V

Copper Dissolution - Effect of Temperature

| Test No. | Temperature (°F.) | wt % Cu In Solution @ 1 Hr. | 2 Hrs. | 3 Hrs. | 4 Hrs. | 5 Hrs. | 6 Hrs. |
|---|---|---|---|---|---|---|---|
| 1 | 72 | 0.04 | 0.11 | 0.24 | 0.32 | 0.40 | 0.49 |
| 2 | 100 | 0.05 | 0.15 | 0.32 | 0.45 | 0.54 | 0.56 |
| 3 | 150 | 0.09 | 0.27 | 0.55 | 0.64 | 0.64 | 0.65 |

Table IV shows that intermittent oxygen injection results in a rate of copper dissolution lower than the rate of copper dissolution achieved by continuous oxygen injection. The results show that there was no significant difference in the rate of copper dissolution achieved by the cleaning solution injected with oxygen for 5 minutes each hour and the rate of copper dissolution achieved by the cleaning solution injected with oxygen for 10 minutes each hour.

The cleaning solution continuously injected with oxygen thoughout the test period contained approximately 0.55% copper in solution after only 3 hours. This is equivalent to the amount of copper present in the other solution after 6 hours. Although these results indicate that solvents continuously injected with gaseous oxygen dissolve copper faster than solutions intermittently injected with gaseous oxygen, the difference in the rates achieved may not be so great in all applications. The results show that each solution contained at least about 0.3% copper after three hours. Copper concentrations of this magnitude are consistent with copper concentrations achieved by cleaning solutions used to clean boilers containing relatively heavy copper deposits. It may be difficult in some applications to observe a significant difference in copper dissolution rates between solutions continuously injected with oxygen and solutions intermittently injected with oxygen.

Table V shows that the rate of copper dissolution achieved by the cleaning solution employed in the process of the present invention increases with increasing temperature.

EXAMPLE IV

Tests were conducted to determine if the rate of copper dissolution achieved by the process of the present invention (inventive process) is increased by carrying out the process under a superatmospheric oxygen pressure. For comparative purposes, the rate of copper dissolution achieved by a copper dissolution process employing sodium bromate as an oxidizing agent (comparative process) was also determined. Finally, the effect of high cleaning solution temperatures in connection with superatmospheric oxygen pressures on the rate of copper dissolution achieved by the inventive process was determined.

The solutions employed in the tests of the inventive process were prepared by combining 8.5% by volume of an aqueous solution consisting of 30% by weight ammonia ($NH_3$), and 0.8% by weight ammonium bicarbonate ($NH_4HCO_3$). The solution employed in the test of the comparative process was prepared by combining 5.6% by volume of an aqueous solution consisting of 30% by weight ammonia ($NH_3$), and 0.35% by weight ammonium bicarbonate ($NH_4HCO_3$) and 0.45% by weight sodium bromate ($NaBrO_3$). Both solutions were prepared to dissolve 0.5% copper by wt. of the solution.

All of the tests were carried out by placing approximately 300 milliliters of the cleaning solution and 1.50 grams of copper powder in a stainless steel autoclave. In each test, the autoclave was pressurized with oxygen to the desired pressure and heated to the desired temperature. The pressure and temperature were monitored throughout the tests. Samples of the cleaning solution were withdrawn at regular intervals throughout the tests and analyzed by colorimetric procedures to determine the copper content thereof.

In a first series of tests, the effect of superatmospheric oxygen pressure on the rate of copper dissolution achieved by the process of the present invention was determined. In each test, the temperature of the autoclave was maintained at 150° F. The first test was conducted under an inert nitrogen ($N_2$) atmosphere while the second test was conducted under an air atmosphere. The remaining tests were conducted under specific superatmospheric oxygen pressures. Although the inventive process is typically carried out under a superatmospheric oxygen pressure by injecting gaseous oxygen into the solvent and allowing the pressure to build to the desired level, gaseous oxygen was not injected into the solution in carrying out these tests. Nevertheless, the effect of superatmospheric oxygen pressure on the rate of copper dissolution achieved by the solution could still be determined. The comparative process employing sodium bromate ($NaBrO_3$) as an oxidizing agent was carried out under an air atmosphere. The results of the first series of tests are shown in Table VI below.

In a second series of tests, the effect of high solvent temperatures in connection with superatmospheric oxygen pressures on the rate of copper dissolution achieved by the inventive process was determined. The results of this second series of tests are shown in Table VII below.

TABLE VI

Copper Dissolution - Effect of Superatmospheric Oxygen Pressure

| Test No. | Atmosphere | $O_2$ Pressure (psig) | wt % Cu In Solution @ 2 Hrs. | 4 Hrs. | 6 Hrs. |
|---|---|---|---|---|---|
| | | Inventive Process | | | |
| 1 | $N_2$ | 0 | 0.03 | 0.03 | 0.03 |
| 2 | Air | 0 | 0.06 | 0.12 | 0.22 |
| 3 | $O_2$ | 25 | 0.07 | 0.14 | 0.23 |
| 4 | $O_2$ | 50 | 0.09 | 0.19 | 0.32 |
| 5 | $O_2$ | 75 | 0.15 | 0.23 | 0.30 |
| 6 | $O_2$ | 100 | 0.17 | 0.27 | 0.35 |
| 7 | $O_2$ | 150 | 0.17 | 0.25 | 0.31 |
| | | Comparative Process | | | |
| 8 | Air | 0 | 0.17 | 0.21 | 0.22 |

TABLE VII

Copper Dissolution - Effect of High Cleaning Solution Temperature in Connection with Superatmospheric Oxygen Pressure

| Test No. | $O_2$ Pressure (psig) | Temperature (°F.) | wt % Cu In Solution @ 2 Hrs. | 4 Hrs. | 6 Hrs. |
|---|---|---|---|---|---|
| 1 | 50 | 200 | 0.24 | 0.35 | 0.43 |
| 2* | 50 | 150 | 0.09 | 0.19 | 0.32 |
| 3 | 75 | 250 | 0.37 | 0.31 | 0.28 |

*Reproduced from Table VI (Test No. 4).

Table VI shows that the rate of copper dissolution achieved by the process of the present invention increases with increasing superatmospheric oxygen pressures up to approximately 75–100 psig. Beyond an oxygen pressure of approximately 75–100 psig, the rate of copper dissolution did not significantly increase. The second test shown in Table VI shows that the solution employed in the process of the present invention effectively dissolves copper under an air atmosphere. The solution was able to dissolve 0.22% copper with oxidation provided merely by oxygen present in the air space above the cleaning solution.

Very little copper was dissolved (0.03% Cu in 6 hours) when the process was carried out under an inert nitrogen atmosphere. The small amount of copper that was dissolved under an inert nitrogen atmosphere is probably due to the presence of small amounts of copper oxide on the copper surface as well as dissolved oxygen in the solvent. The results of Test No. 8 show that the solution employing sodium bromate as an oxidizing agent initially dissolved copper at a faster rate than the solutions of the inventive process exposed to an oxygen pressure of less than 75 psig. The ultimate capacity of the ammoniacal bromate solvent to dissolve copper was reached after approximately 4 hours.

Table VII shows that rapid copper dissolution can be achieved at elevated temperatures employed in connection with superatmospheric oxygen pressures.

Very rapid copper dissolution was achieved by the solution at 250° F. (Test No. 3) as evidenced by the relatively high dissolved copper concentration (0.37 wt % Cu in solution) present at 2 hours into the test period. After 2 hours, however, the dissolved copper concentration began to decline. Visual examination of the test vessel after this test revealed that a black coating was deposited on the walls of the vessel, particularly in the area of the liquid-cleaning solution interface. It is believed that the black coating resulted from the deposition of copper oxides due to a lack of sufficient ammonia to complex the amount of copper present in the solution. The large vapor space present in the autoclave together with the elevated temperature (250° F.) apparently resulted in excessive ammonia losses from the liquid cleaning solution phase.

Although the above experimental technique (large vapor space relative to solution volume) is not necessarily consistent with actual boiler cleaning operations where the actual vapor space is probably no more than 10% of the cleaning volume, the above tests show that cleaning operations can be conducted at elevated temperatures.

The preceding examples can be repeated with similar success by substituting the generically or specifically described reactants and/or operating conditions of this invention for those used in the examples.

Although certain preferred embodiments of the invention have been described for illustrative purposes, it will be appreciated that various modifications and innovations of the process recited herein may be effected without departure from the basic principals which underlie the invention. Changes of this type are therefore deemed to lie within the spirit and scope of the invention except as may be reasonably limited by the claims or reasonable equivalents thereof.

What is claimed is:

1. A process for removing copper from a surface comprising:

contacting the copper with sufficient quantities of gaseous oxygen such that copper oxide is formed; and contacting the copper oxide with a solution comprising said gaseous oxygen and sufficient amounts of ammonia and an inorganic ammonium salt to dissolve at least a substantial portion of the copper oxide.

2. The process of claim 1 wherein the solution contacting the copper oxide is agitated.

3. The process of claim 1 wherein the solution contacting the copper oxide is heated to a temperature of at least about 100° F.

4. The process of claim 1 wherein the first contacting step is performed in an environment having a pressure of at least about 0 psig.

5. The process of claim 1 wherein the concentration of the inorganic ammonium salt is in the range of from about 0.01% to about 4% by weight of solution and the ammonia is in the range of from about 0.04% to about 10% by weight of solution.

6. The process of claim 1 wherein said inorganic ammonium salt is selected from a group consisting of ammonium bicarbonate, ammonium nitrate, ammonium sulfate, ammonium carbonate and ammonium phosphate.

7. A process for removing copper from a surface comprising:

contacting the copper with a solution comprising;

sufficient quantities of gaseous oxygen such that copper oxide is formed; and wherein said solution includes sufficient amounts of ammonia and an inorganic ammonium salt to dissolve at least a substantial portion of the copper oxide.

8. The process of claim 7 wherein the concentration of inorganic ammonium salt is in the range of from about 0.01% to about 4% by weight of solution and the ammonia is in the range of from about 0.04% to about 10% by weight of solution.

9. The process of claim 7 wherein the solution contacting the copper is heated to a temperature of at least about 100° F.

10. The process of claim 7 wherein the contacting step is performed in an environment having a pressure of at least about 0 psig.

11. The process of claim 7 wherein said inorganic ammonium salt is selected from a group consisting of ammonium bicarbonate, ammonium nitrate, ammonium sulfate, ammonium carbonate and ammonium phosphate.

12. A process for removing copper from a surface comprising:

contacting the copper with a solution comprising gaseous oxygen present in sufficient quantities such that copper oxide is formed and sufficient amounts of ammonia and an inorganic ammonium salt to dissolve at least a substantial portion of the copper oxide; and said gaseous oxygen being injected into said solution such that said solution is agitated.

13. The process of claim 12 wherein the concentration of the inorganic ammonium salt is in the range of from about 0.01% to about 4% by weight of solution and the ammonia is in the range of from about 0.04% to about 10% by weight of solution.

14. The process of claim 13 wherein said gaseous oxygen is intermittently injected into the solution.

15. The process of claim 12 wherein said gaseous oxygen is injected into the solution at a rate in the range of from about 1 scfm per 10,000 gal. to about 200 scfm per 10,000 gal.

16. The process of claim 12 wherein the solution contacting the copper is heated to at least 100° F.

17. The process of claim 12 wherein the contacting step is performed in an environment having a pressure in the range of from 0 psig to about 100 psig.

18. The process of claim 12 wherein said inorganic ammonium salt is selected from a group consisting of ammonium nitrate, ammonium sulfate, ammonium carbonate and ammonium phosphate.

* * * * *